US005803723A

United States Patent [19]

Suefuji et al.

[11] Patent Number: 5,803,723

[45] Date of Patent: Sep. 8, 1998

[54] SCROLL FLUID MACHINE HAVING SURFACE COATING LAYERS ON WRAPS THEREOF

[75] Inventors: Kazutaka Suefuji, Kanagawa-ken; Yuji Komai, Tokyo; Yoshio Kobayashi; Hiroyuki Mihara, both of Kanagawa-ken, all of Japan

[73] Assignee: Tokico Ltd., Kawasaki, Japan

[21] Appl. No.: 752,438

[22] Filed: Nov. 14, 1996

[30] Foreign Application Priority Data

Nov. 20, 1995 [JP] Japan ..... 7-325178

[51] Int. Cl.[6] ..... F01C 1/04; F01C 17/06; F01C 21/08; F01C 21/10

[52] U.S. Cl. ..... 418/55.2; 418/55.5; 418/56; 418/57

[58] Field of Search ..... 418/55.2, 55.5, 418/56, 57

[56] References Cited

U.S. PATENT DOCUMENTS 3,986,799 10/1976 McCullough ..... 418/56

FOREIGN PATENT DOCUMENTS 57-49001 3/1982 Japan ..... 418/56
61-79883 4/1986 Japan ..... 418/55.2

*Primary Examiner*—John J. Vrablik
*Attorney, Agent, or Firm*—Wenderoth, Lind & Ponack, L.L.P.

[57] ABSTRACT

A wrap of an orbiting scroll member and a wrap of a fixed scroll member are each provided with a non-rigid surface coating layer having a predetermined thickness. An orbiting radius varying mechanism is provided between a driving shaft and the orbiting scroll member, thereby gradually increasing the orbiting radius of the orbiting scroll member at the initial stage of running, and thus positively allowing the surface coating layers to wear by rubbing against each other. A stopper mechanism is provided between the driving shaft and the orbiting scroll member to regulate the rotation angle of a variable crank relative to the driving shaft to a predetermined rotation angle, thereby preventing the surface coating layers from being excessively worn as the orbiting radius of the orbiting scroll member increases.

3 Claims, 9 Drawing Sheets

SCROLL FLUID MACHINE HAVING SURFACE COATING LAYERS ON WRAPS THEREOF

BACKGROUND OF THE INVENTION

1. Field of the Invention

The present invention relates to a scroll fluid machine which is suitably used as an air compressor, a vacuum pump, etc., by way of example.

2. Related Background Art

A known scroll fluid machine has a casing and a fixed scroll member integral with the casing. The fixed scroll member has a spiral wrap standing on an end plate. A driving shaft is rotatably supported at a proximal end thereof by the casing. The distal end portion of the driving shaft extends into the casing. An orbiting scroll member is orbitably provided on the distal end portion of the driving shaft. The orbiting scroll member has a spiral wrap standing on an end plate so as to overlap the wrap of the fixed scroll member to define a plurality of compression chambers therebetween.

In this type of conventional scroll fluid machine, the driving shaft is externally driven to rotate, causing the orbiting scroll member to perform an orbiting motion with a predetermined eccentricity with respect to the fixed scroll member, thereby sucking a fluid, e.g. air, from a suction opening provided at the outer periphery of the fixed scroll member, and successively compressing the fluid in the compression chambers formed between the wraps of the fixed and orbiting scroll members. Finally, the compressed fluid is discharged to the outside from a discharge opening provided in the center of the fixed scroll member.

In the above-described conventional scroll fluid machine, a plurality of compression chambers are formed between the wraps of the fixed and orbiting scroll members. Therefore, if the degree of gas-tightness in each compression chamber formed between the wraps is not sufficiently high, satisfactory compression performance cannot be obtained.

To solve the problem of the conventional scroll fluid machine, Japanese Patent Application Post-Examination Publication No. 6-3192, for example, proposes a scroll compressor. In the scroll compressor, a disk-shaped follower crank is interposed between a driving shaft and an orbiting scroll member. The follower crank is provided with a follower link hole (first axis) for the crank to be rotatably fitted to a distal end portion of the driving shaft at a position eccentric with respect to the axis of the driving shaft, and an eccentric hole (second axis) for rotatably supporting the orbiting scroll member. The eccentric hole is eccentric with respect to both the axis of the follower link hole and the axis of the driving shaft. In addition, a stopper is provided between the follower crank and the driving shaft to restrain free rotation of the follower crank.

According to the above-described conventional technique, centrifugal force and gas (fluid) pressure in each compression chamber act on the orbiting scroll member during a compression operation. By utilizing these forces, the orbiting radius of the orbiting scroll member is slightly increased by means of the follower crank, and the gap between the wraps is reduced, thereby increasing the degree of gas-tightness in each compression chamber.

However, it is impossible even with this technique to accurately regulate the variation in the orbiting radius of the orbiting scroll member by the stopper because the stopper is arranged to restrain free rotation of the follower crank. Therefore, during a compression operation, the follower crank may allow the orbiting radius of the orbiting scroll member to become larger than is necessary, causing the wrap of the orbiting scroll member to contact (slide on) the wrap of the fixed scroll member in such a manner that the former is strongly pressed against the latter. If the running is continued with the wraps being in contact with each other at all times, the wraps wear at a high rate. Accordingly, the durability of the machine degrades remarkably.

Further, according to the conventional technique, although the surface of each wrap is machined to form a smooth curved surface, the wrap surface is slightly uneven within the machining tolerance. Therefore, even if the gap between the wraps can be reduced by the follower crank, there is a limit to the attainable degree of gas-tightness in each compression chamber formed between the wraps. Accordingly, the compression performance cannot always be improved satisfactorily.

SUMMARY OF THE INVENTION

In view of the above-described problems with the conventional techniques, an object of the present invention is to provide a scroll fluid machine wherein the orbiting radius of the orbiting scroll member is made variable, thereby enabling an increase in the degree of gas-tightness in each compression chamber, and making it possible to readily compensate for errors in machining the wrap surface of the orbiting scroll member and the wrap surface of the fixed scroll member, and thus allowing the compression performance to be improved satisfactorily.

The present invention is applicable to a scroll fluid machine including a casing and a fixed scroll member integral with the casing. The fixed scroll member has a spiral wrap standing on an end plate. A driving shaft is rotatably supported at a proximal end thereof by the casing. The driving shaft has a distal end portion extending into the casing. An orbiting scroll member is orbitably provided on the distal end portion of the driving shaft. The orbiting scroll member has a spiral wrap standing on an end plate so as to overlap the wrap of the fixed scroll member to define a plurality of compression chambers therebetween.

An arrangement adopted by the present invention is characterized in that a surface coating layer is formed on at least either one of the wraps of the orbiting scroll member and fixed scroll member, the surface coating layer being made of a material less rigid than the wraps, and that an orbiting radius varying mechanism is provided between the distal end of the driving shaft and the orbiting scroll member to vary an orbiting radius of the orbiting scroll member, and further that a stopper mechanism is provided on the orbiting radius varying mechanism to regulate the variation in the orbiting radius of the orbiting scroll member to a value smaller than the thickness of the surface coating layer.

With the above-described arrangement, at the initial stage of running, the surface coating layer formed on the wrap of the orbiting scroll member can be brought into sliding contact with the surface coating layer formed on the wrap of the fixed scroll member by increasing the orbiting radius of the orbiting scroll member through the orbiting radius varying mechanism. Thus, the surface coating layers on the wraps are positively worn out by rubbing against each other, thereby enabling the surface configuration (external configuration) of the surface coating layer on each wrap to be formed into a smooth curved surface without irregularities. Moreover, when the wear of the surface coating layer on each wrap has progressed to a predetermined extent, the stopper mechanism functions against the orbiting radius varying mechanism, thereby surely preventing the surface coating layer on each wrap from being scraped off entirely.

DETAILED DESCRIPTION OF THE PREFERRED EMBODIMENTS

Figure 1:
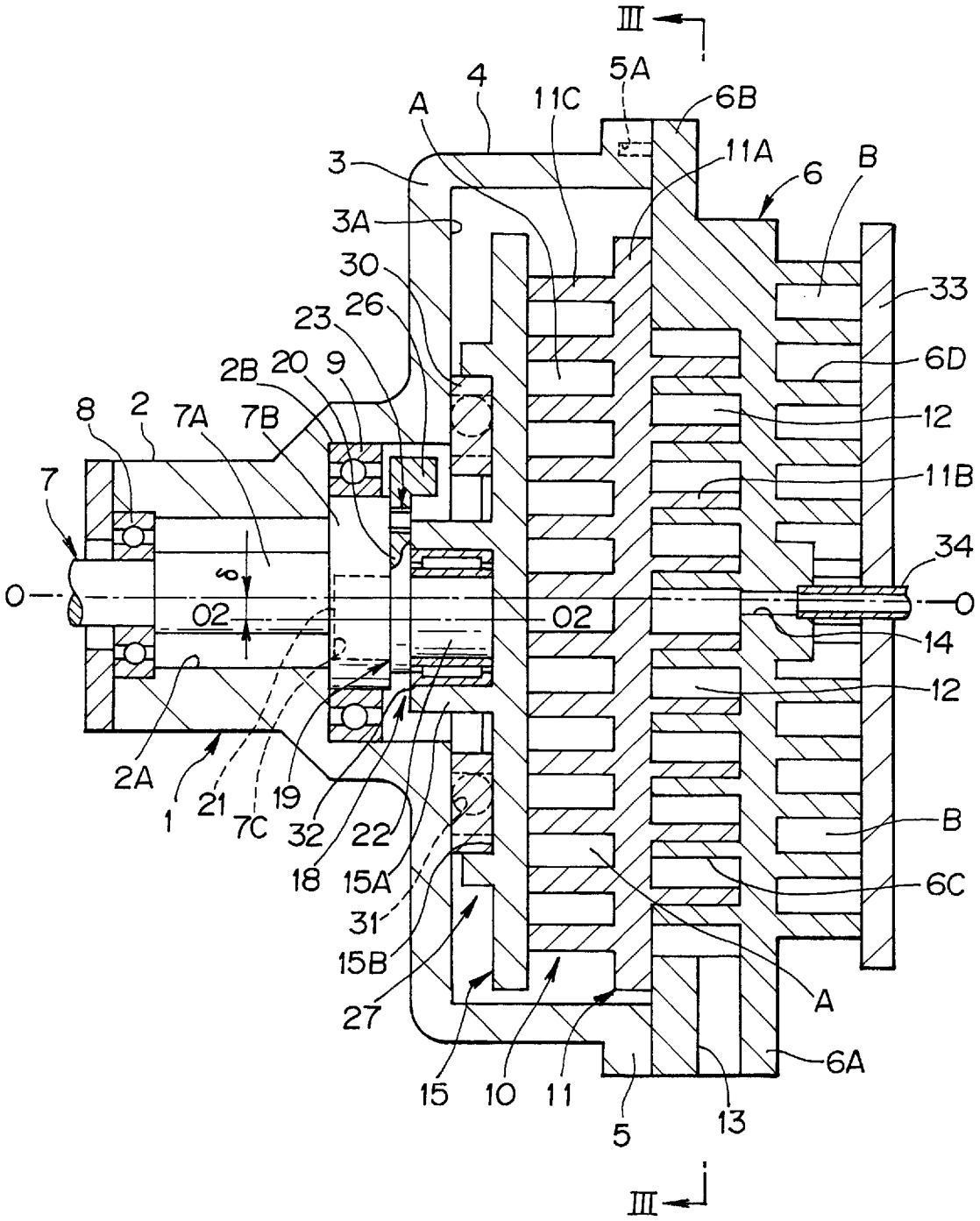
FIG. 1 is a longitudinal sectional view of a scroll air compressor according to a first embodiment of the present invention.

Embodiments of the scroll fluid machine according to the present invention will be described below in detail with reference to the accompanying drawings by way of examples in which the present invention is applied to an oilless scroll air compressor.

FIGS. 1 to 5(*b*) show a first embodiment of the present invention.

In such figures, a stepped cylinder-shaped casing 1 forms an outer frame of a scroll air compressor. The casing 1 has a bearing portion 2 formed in the shape of a cylinder having a relatively small diameter. An annular flange portion 3 extends radially outward from the proximal end of the bearing portion 2. A cylindrical large-diameter portion 4 projects axially from the outer periphery of the flange portion 3. An annular butt portion 5 projects radially outward from the distal end of the large-diameter portion 4.

The bearing portion 2 of the casing 1 is provided with a long, small-diameter hole 2A and a short, large-diameter hole 2B extending from the small-diameter hole 2A to open into the large-diameter portion 4. The large-diameter hole 2B accommodates a boss portion 15A of an orbiting scroll member 10 (described later), a variable crank 19, etc.

Figure 2:
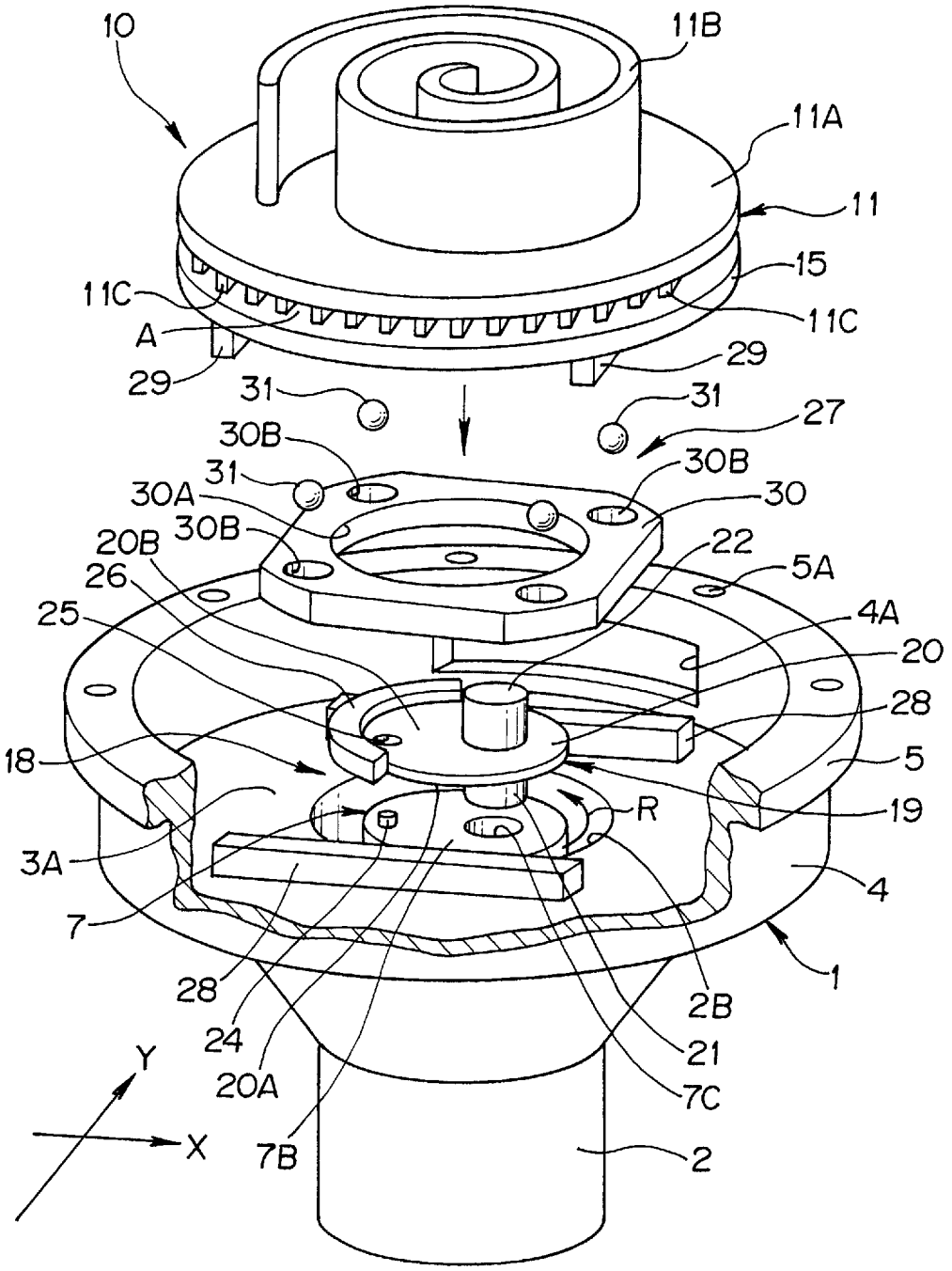
FIG. 2 is an exploded perspective view showing a casing, an orbiting scroll member, a rotation preventing mechanism and an orbiting radius varying mechanism in the arrangement shown in FIG. 1.

The flange portion 3 of the casing 1 has an inner surface defined as a sliding surface 3A on which spheres 31 (described later) slide (roll). As shown in FIG. 2, the large-diameter portion 4 of the casing 1 is provided with a cooling air inlet 4A for circulating cooling air in the casing 1, and a cooling air outlet (not shown) lying opposite the cooling air inlet 4A. The butt portion 5 of the casing 1 is provided with bolt holes 5A for mounting a fixed scroll member 6 (described later).

The fixed scroll member 6 is fixed to the distal end of the casing 1. The fixed scroll member 6 has an approximately disk-shaped end plate 6A disposed such that the center of the end plate 6A is coincident with an axis O—O of a driving shaft 7. A mounting flange portion 6B projects from the outer edge of the end plate 6A and is fixed at its outer periphery to the butt portion 5 of the casing 1 through bolts (not shown) or the like. A wrap 6C is provided on the end plate 6A so as to project axially from the surface of the end plate 6A. The center of the wrap 6C is a spiral starting end, and the outer peripheral end of the wrap 6C is a spiral terminating end. A large number of radiating plates 6D are provided in parallel on the back of the end plate 6A.

The wrap 6C of the fixed scroll member 6 is formed as a thin plate made of a rigid metallic material or the like. As shown in the enlarged view of FIG. 3, both sides of the wrap 6C are uneven because of machining errors.

The driving shaft 7 has a stepped column-like shape and extends axially through the bearing portion 2. The driving shaft 7 has at its proximal end a small-diameter columnar portion 7A rotatably supported through a bearing 8 in the small-diameter hole 2A. The driving shaft 7 further has a large-diameter disk portion 7B integral with the distal end of the columnar portion 7A. The disk portion 7B is rotatably supported through a bearing 9 in the large-diameter hole 2B. The axes of the columnar and disk portions 7A and 7B of the driving shaft 7 are coincident with each other to form an axis O—O (hereinafter referred to as "axis O").

Figure 5:
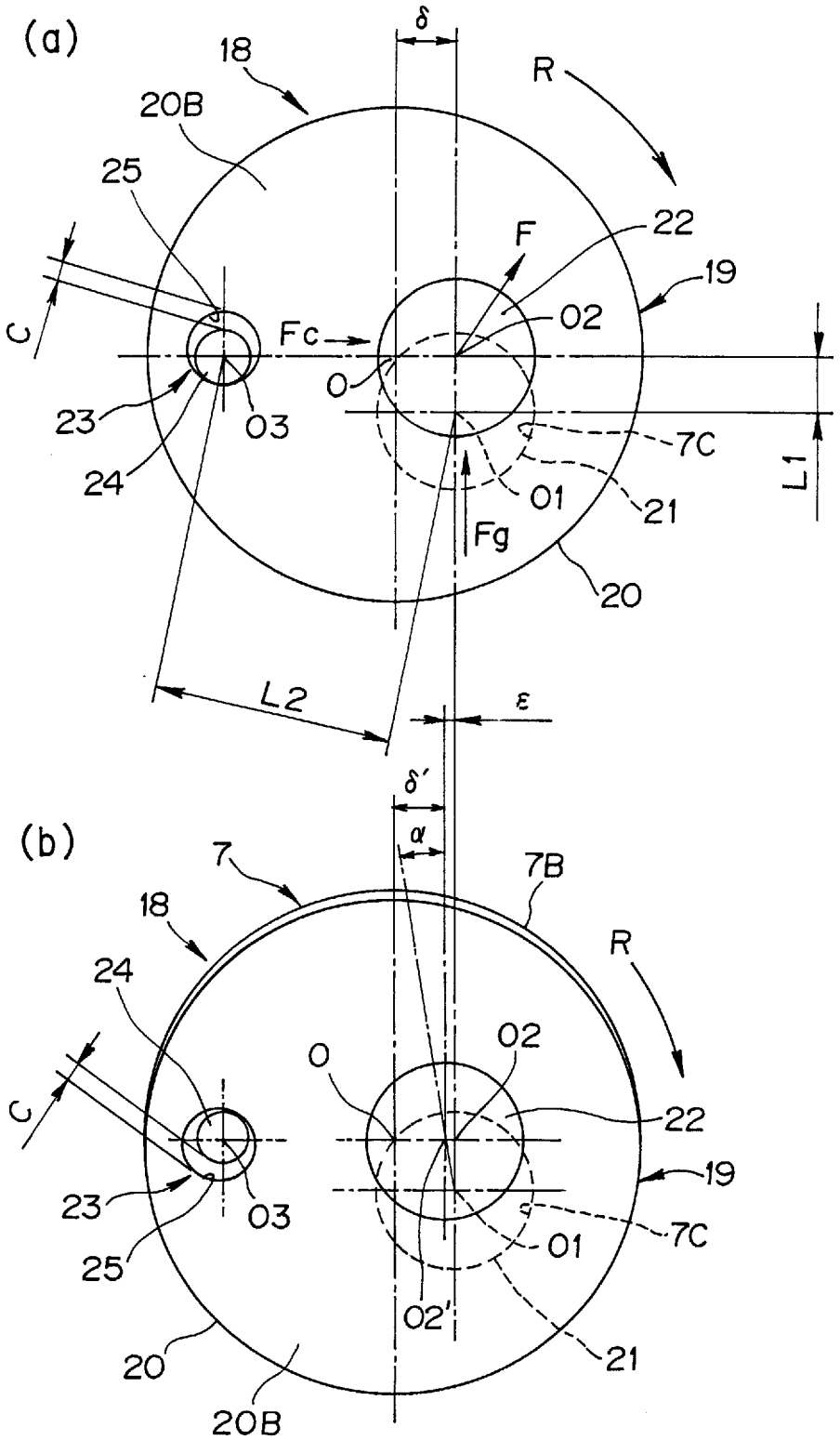
FIGS. 5(*a*) and 5(*b*) are enlarged views for describing an operation of the orbiting radius varying mechanism, shown in FIG. 1.
Figure 5A:
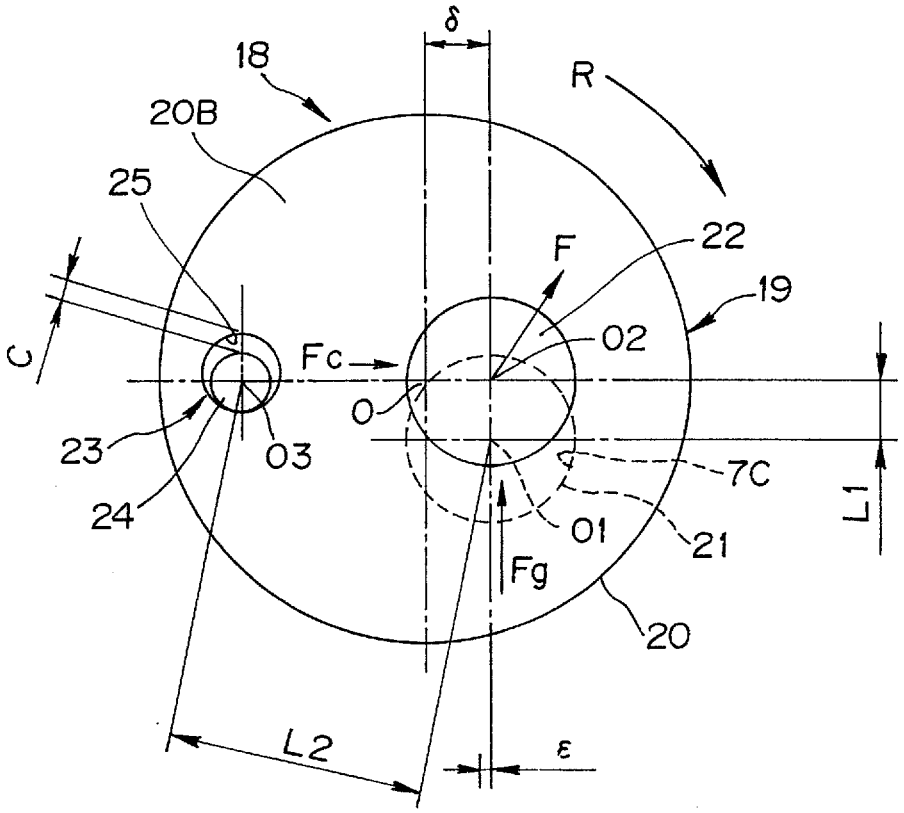
Figure 5B:
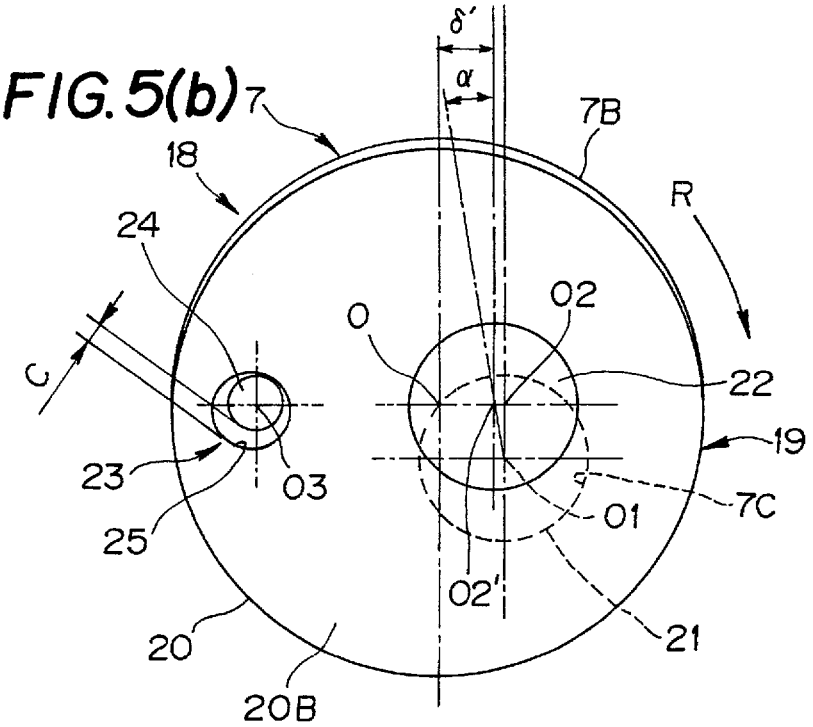

As shown in FIGS. 2, 5(*a*) and 5(*b*), the distal end surface of the disk portion 7B of the driving shaft 7 is provided with a fitting hole 7C having a circular cross-sectional configuration. The fitting hole 7C lies adjacent to the center of the end surface of the disk portion 7B. In addition, a pin 24 (described later) is formed on the distal end surface of the disk portion 7B at a position adjacent to the outer periphery of the disk portion 7B. The axis (axial center) O1 of the fitting hole 7C is eccentric with respect to the axis O of the driving shaft 7 by a predetermined dimension.

The proximal end portion of the driving shaft 7 projects from the casing 1 and is connected to a drive source (not shown). As the driving shaft 7 is driven to rotate in the direction of the arrow R, as shown in FIGS. 2, 5(*a*) and 5(*b*), by the drive source, the orbiting scroll member 10 performs an orbiting motion through a variable crank 19, orbiting bearing 32 and rotation preventing mechanism 27 (described later).

The orbiting scroll member 10 is orbitably provided in the casing 1 opposite to the fixed scroll member 6. The orbiting scroll member 10 has an integral structure comprising an orbiting scroll body 11 (described later) and a back plate 15 (described later) provided at the back of the orbiting scroll body 11.

As shown in FIG. 2, the orbiting scroll body 11 has an end plate 11A formed in the shape of a disk. A wrap 11B is provided on the end plate 11A so as to project axially from the surface of the end plate 11A. The center of the wrap 11B is a spiral starting end, and the outer peripheral end of the wrap 11B is a spiral terminating end. A large number of radiating plates 11C are provided in parallel on the back of the end plate 11A. The wrap 11B of the orbiting scroll body 11 is formed in the same way as the wrap 6*c* of the fixed scroll member 6. As shown in the enlarged view of FIG. 3, both sides of the wrap 11B are uneven.

The orbiting scroll body 11 is disposed such that, as shown in FIG. 1, the wrap 11B overlaps the wrap 6C of the fixed scroll member 6 with a predetermined offset angle (e.g. 180 degrees). Thus, a plurality of compression chambers 12 are formed between the two wraps 6C and 11B. During running of the scroll air compressor, air is sucked into a compression chamber 12 arriving at the outer periphery through a suction opening 13 provided at the outer periphery of the fixed scroll member 6. The suctioned air is successively compressed in the compression chambers 12 while the orbiting scroll member 10 is performing an orbiting motion. Finally, the compressed air is discharged to the outside from the compression chamber 12 having moved to the center through a discharge opening 14 provided in the center of the fixed scroll member 6.

The back plate 15, which is provided at the back of the orbiting scroll body 11, is formed in the shape of a disk having approximately the same diameter as that of the end plate 11A of the orbiting scroll body 11. The back plate 15 has a boss portion 15A projecting axially from the center of the back thereof toward the bearing portion 2 of the casing 1. The back plate 15 is fixed to the distal ends of the radiating plates 11C on the orbiting scroll body 11 through bolts (not shown) or the like. Thus, a plurality of cooling air passages A are defined between the back plate 15 and the radiating plates 11C to enable the back of the end plate 11A of the orbiting scroll body 11 and other portions to be efficiently cooled by cooling air supplied externally.

An area on the back of the back plate 15 which is defined between Y-axis guides 29 (described later) is defined as a sliding surface 15B. A movable plate 30 (described later) performs a relative sliding motion over the sliding surface 15B through spheres 31.

Figure 3:
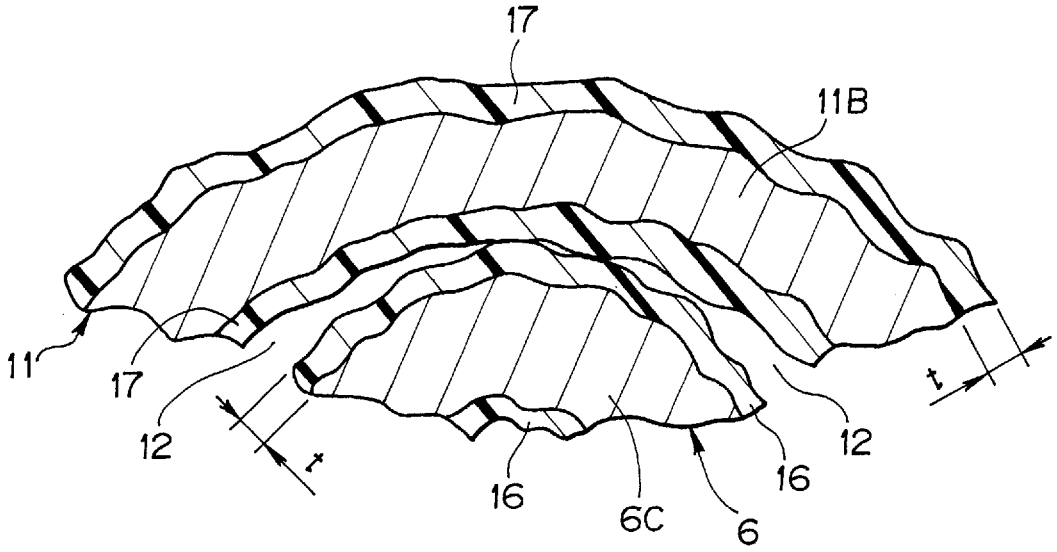
FIG. 3 is an enlarged sectional view in the direction of the arrow III—III in FIG. 1, showing conditions of wraps of orbiting and fixed scroll members, together with surface coating layers, at an initial stage of running.
Figure 4:
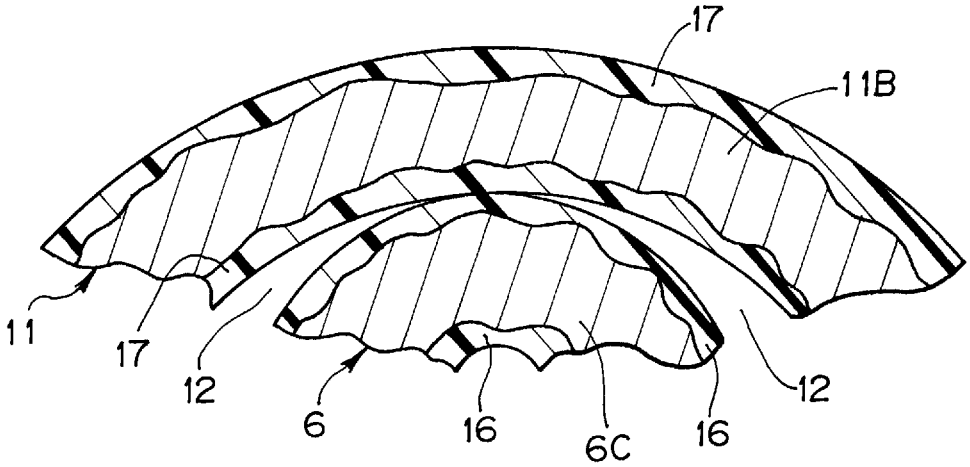
FIG. 4 is a sectional view similar to FIG. 3, showing conditions of the surface coating layers during normal running.

Referring to FIGS. 3 and 4, the wrap 6C of the fixed scroll member 6 has surface coating layers 16 formed on both sides thereof. The wrap 11B of the orbiting scroll member 10 also has surface coating layers 17 formed on both sides thereof. The surface coating layers 16 are formed by coating both sides of the wrap 6C with a material less rigid than the wraps 6C and 11B, for example, molybdenum disulfide, fluorine resin (polytetrafluoroethylene) or phosphoric acid film. Similarly, the surface coating layers 17 are formed by coating both sides of the wrap 11B with a material less rigid than the wraps 6C and 11B as described above.

The surface coating layers 16 and 17 may be formed by subjecting the sides of the wraps 6C and 11B to a surface modification process such as nitrosulfurizing or a process to make an anodic oxidation film with PTFE filling pores of the film. At the initial stage of running, the surfaces of the surface coating layers 16 and 17 are uneven in conformity to the corresponding sides of the wraps 6C and 11B. The thickness t (see FIG. 3) of each surface coating layer is set at about several tens of micrometers.

An orbiting radius varying mechanism 18 is provided between the distal end of the driving shaft 7 and the orbiting scroll member 10. The orbiting radius varying mechanism 18 comprises a variable crank 19 and a stopper mechanism 23 (described later). During running of the scroll fluid machine, the orbiting radius varying mechanism 18 varies the orbiting radius of the orbiting scroll member 10.

The variable crank 19 is interposed between the distal end of the driving shaft 7 and the orbiting scroll member 10, lying in the large-diameter hole 2B of the bearing portion 2. As shown in FIG. 2 and also in FIGS. 5(*a*) and 5(*b*), the variable crank 19 comprises a disk 20 having a diameter approximately equal to that of the disk portion 7B of the driving shaft 7. The disk 20 has an approximately columnar fitting shaft 21 integrally formed with it. The fitting shaft 21 projects from one end surface 20A of the disk 20 as a first shaft. The disk 20 further has an approximately columnar eccentric shaft 22 integrally formed with it. The eccentric shaft 22 projects from the other end surface 20B of the disk 20 as a second shaft. Moreover, the disk 20 is provided with a pin hole 25 (described later). The fitting shaft 21 has an outer diameter approximately equal to the diameter of the fitting hole 7C in the driving shaft 7 so that the fitting shaft 21 is rotatably fitted into the fitting hole 7C. The distal end of the eccentric shaft 22 is rotatably fitted in the boss portion 15A of the orbiting scroll member 10 through an orbiting bearing 32 (described later).

As shown in FIGS. 5(*a*) and 5(*b*), the fitting shaft 21 has an axis O1 which is coincident with the axis O1 of the fitting hole 7C but eccentric with respect to the axis O of the driving shaft 7 by a predetermined dimension. The eccentric shaft 22 has an axis (axial center) O2 (O2') which is coincident with the axis O2 of the orbiting scroll member 10 but eccentric with respect to both the axis O of the driving shaft 7 and the axis O1 of the fitting hole 7C. The center-to-center distance between the axes O1 and O2 is set at a rather short distance L1.

The variable crank 19 allows the fitting shaft 21 to rotate (move) in the fitting hole 7C of the driving shaft 7 within a clearance C (described later), thereby making the eccentric shaft 22 move around the axis O1 of the fitting shaft 21.

At the initial stage of running, as shown in of FIG. 5(*b*), the position of the variable crank 19 relative to the driving shaft 7 is determined such that the axis of the eccentric shaft 22 lies at the position of an axis O2' for the reason set forth later. In this state, the center-to-center distance between the axes O2 and O, that is, the orbiting radius of the orbiting scroll member 10, is set at a minimum value δ'. When the machine has come into a normal running condition with the surface coating layers 16 and 17 worn out as shown in FIG. 4, the variable crank 19 is positioned by means of a stopper mechanism 23 such that the axis of the eccentric shaft 22 is coincident with the axis O2, as shown in FIG. 5(*a*). In this state, the center-to-center distance between the axes O2 and O, that is, the orbiting radius of the orbiting scroll member 10, is set at a maximum value δ (δ>δ').

The stopper mechanism 23 comprises a columnar pin 24 projecting from the distal end surface of the disk portion 7B of the driving shaft 7, and a pin hole 25 provided in the disk 20 of the variable crank 19 and fitted with the pin 24. The inner diameter of the pin hole 25 is larger than the outer diameter of the pin 24 to form a gap with a clearance C between the pin 24 and the pin hole 25. The pin 24 is disposed on the outer peripheral portion of the disk portion 7B. The center-to-center distance between the axis (axial center) O3 of the pin 24 and the axis O1 of the fitting shaft 21 is set at a distance L2 sufficiently longer than the center-to-center distance L1 between the axis O1 and the axis O of the driving shaft 7 (L2>L1).

As the variable crank 19 is driven to rotate by the driving shaft 7, the surface coating layers 16 and 17 gradually wear so as to be ground to have smooth surfaces as shown in FIG. 4. Consequently, the variable crank 19 rotates relative to the driving shaft 7, and eventually, the pin 24 comes in engagement with the inner wall surface of the pin hole 25 as shown in FIG. 5(*a*), thus preventing the variable crank 19 from further rotating relative to the driving shaft 7. That is, at the initial stage of running, the eccentric shaft 22 has its axis at the position of the axis O2' as shown in FIG. 5(*b*), whereas, at the time of normal running, the eccentric shaft 22 is positioned by the stopper mechanism 23 such that its axis is coincident with the axis O2.

Thus, the rotation angle of the variable crank 19 relative to the driving shaft 7 is regulated to a predetermined angle α, thereby enabling the variation in the orbiting radius of the orbiting scroll member 10 to be regulated to a value ε (ε=δ−δ'). The value ε is set at a small value smaller than the thickness t of the surface coating layers 16 and 17.

A counterweight 26 is provided on the disk 20. The counterweight 26 is formed in the shape of a circular arc and provided such that the inner peripheral surface thereof is connected to the outer peripheral surface of the disk 20. The counterweight 26 may be formed integral with or separately from the disk 20. The counterweight 26 balances the rotation of the whole driving shaft 7, including the variable crank 19, with the orbiting motion of the orbiting scroll member 10.

A rotation preventing mechanism 27 prevents the orbiting scroll member 10 from rotating around its own axis. As shown in FIGS. 1 and 2, the rotation preventing mechanism 27 comprises X-axis guides 28, Y-axis guides 29, a movable plate 30, and spheres 31. The movable plate 30 is slidingly displaced in the direction X relative to the casing 1, while the orbiting scroll member 10 is slidingly displaced in the direction Y relative to the movable plate 30, thereby preventing rotation of the orbiting scroll member 10, which is integral with the Y-axis guides 29, while allowing the orbiting scroll member 10 to perform a circular motion (orbiting motion) with the predetermined orbiting radius δ. Thus, the rotation preventing mechanism 27 constitutes an Oldham's coupling.

The X-axis guides 28 are integrally provided on the sliding surface 3A of the flange portion 3 (casing 1). As shown in FIG. 2, the X-axis guides 28 are formed in the shape of elongated square plates and disposed to extend in the X-axis direction in parallel to each other with a predetermined spacing in the Y-axis direction. The X-axis guides 28 are disposed to face each other across the large-diameter hole 2B of the casing 1 at equal distances from the large-diameter hole 2B. The movable plate 30 is fitted between the X-axis guides 28 to ensure the sliding displacement of the movable plate 30 in the X-axis direction relative to the casing 1 while preventing sliding displacement of the movable plate 30 in the Y-axis direction.

The Y-axis guides 29 are integrally provided on the sliding surface 15B of the back plate 15 (orbiting scroll member 10). The Y-axis guides 29 are formed in the shape of elongated square plates as in the case of the X-axis guides 28. The Y-axis guides 29 extend in the Y-axis direction in parallel to each other with a predetermined spacing in the X-axis direction. The Y-axis guides 29 are disposed to face each other across the boss portion 15A of the back plate 15 at equal distances from the boss portion 15A. The movable plate 30 is fitted between the Y-axis guides 29 to ensure sliding displacement of the orbiting scroll member 10 in the Y-axis direction relative to the movable plate 30 while preventing sliding displacement of the orbiting scroll member 10 in the X-axis direction.

The movable plate 30 is slidably disposed between the flange portion 3 of the casing 1 and the back plate 15 of the orbiting scroll member 10. As shown in FIG. 2, the movable plate 30 is formed in the shape of an approximately square flat plate from a metal or other plate of high strength. The center of the movable plate 30 is provided with a clearance hole 30A through which the boss portion 15A of the back plate 15 extends. The clearance hole 30A also serves to prevent the movable plate 30 from colliding with the boss portion 15A as it is slidingly displaced. The four corners of the movable plate 30 are provided with through-holes 30B, respectively. The through-holes 30B are circumferentially spaced so as to lie outside the boss portion 15A of the back plate 15. Each through-hole 30B has a sphere 31 inserted therein together with grease (described later).

Side surfaces of the movable plate 30 which extend in parallel in the X-axis direction serve as sliding surfaces with respect to the X-axis guides 28. Side surfaces of the movable plate 30 which extend in parallel in the Y-axis direction serve as sliding surfaces with respect to the Y-axis guides 29. The direction of displacement of the movable plate 30 relative to the sliding surface 3A of the flange portion 3 is restricted to the X-axis direction by the X-axis guides 28. The direction of displacement of the sliding surface 15B (back plate 15) relative to the movable plate 30 is restricted to the Y-axis direction by the Y-axis guides 29.

The spheres 31, which are inserted in the through-holes 30B of the movable plate 30, are formed as spherical balls of a metallic material more rigid than the movable plate 30. The diameter of each sphere 31 is slightly larger than the thickness of the movable plate 30. The spheres 31 prevent the obverse and reverse surfaces of the movable plate 30 from coming in direct sliding contact with the sliding surface 3A of the flange portion 3 and the sliding surface 15B of the back plate 15, respectively. Moreover, the spheres 31 directly bear a thrust load (pressing force) applied from the orbiting scroll member 10.

With the spheres 31 accommodated therein, the through-holes 30B of the movable plate 30 are held in an approximately sealed state between the sliding surfaces 3A and 15B, as shown in FIG. 1. Grease (not shown) serving as a lubricant is sealed in the through-holes 30B of the movable plate 30, thereby enabling the spheres 31 to smoothly roll in the respective through-holes 30B of the movable plate 30 while maintaining the spheres 31 in a lubricated condition when the obverse and reverse surfaces of the movable plate 30 are slidingly displaced on the sliding surfaces 3A and 15B, respectively.

An orbiting bearing 32 is provided in the boss portion 15A of the back plate 15 to rotatably support the distal end of the eccentric shaft 22 of the variable crank 19 in the boss portion 15A.

A cover 33 is provided at the back of the fixed scroll member 6. The cover 33 is fixed to the distal ends of the radiating plates 6D on the fixed scroll member 6 through bolts (not shown). Thus, a plurality of cooling air passages B are defined between the cover 33 and the radiating plates 6D to enable the end plate 6A and wrap 6C of the fixed scroll member 6 and other portions to be efficiently cooled by cooling air supplied externally.

A discharge pipe 34 is connected at its proximal end to the discharge opening 14 in the center of the fixed scroll member 6. The distal end portion of the discharge pipe 34 extends through the cover 33 to project outside and is connected to an air tank or the like.

The scroll air compressor according to this embodiment, which has the above-described arrangement, operates as follows:

First, when the driving shaft 7 is rotated in the direction of the arrow R (see FIGS. 5(*a*) and 5(*b*)) by an electric motor, the orbiting scroll member 10 performs a circular motion (orbiting motion) with a predetermined orbiting radius δ (minimum value δ' at the initial stage of running) centered on the driving shaft 7 while being prevented from rotating around its own axis by the rotation preventing mechanism 27. During at least normal running, the compression chambers 12, which are defined between the wrap 6C of the fixed scroll member 6 and the wrap 11B of the orbiting scroll member 10 (orbiting scroll body 11), are continuously contracted by the circular motion of the orbiting scroll member 10. Thus, the outside air sucked in from the suction opening 13 of the fixed scroll member 6 is successively compressed in the compression chambers 12, and the compressed air is discharged from the discharge opening 14 of the fixed scroll member 6 through the discharge pipe 34 and stored in the external air tank or the like.

At the distal end surface of the disk portion 7B of the driving shaft 7, the fitting shaft 21 of the variable crank 19 is rotatably provided in the fitting hole 7C, and the eccentric shaft 22 is disposed such that its axis O2 is eccentric with respect to the axis O. Because the axis O2 is eccentric with respect to the axis O, the eccentric shaft 22 is subjected to centrifugal force Fc acting radially outward of the disk portion 7B, as shown in part (a) of FIG. 5(*a*). The magnitude of the force Fc is considerably large because it is proportional to the sum of the mass of the eccentric shaft 22 and the mass of the orbiting scroll member 10.

Moreover, because the orbiting scroll member 10 continuously contracts the compression chambers 12 by performing an orbiting motion relative to the fixed scroll member 6, the pressure Fg of gas compressed in the compression chambers 12 acts on the eccentric shaft 22, which drives the orbiting scroll member 10 to make the circular motion through the orbiting bearing 32. The pressure Fg creates a force in a direction to resist the orbiting motion of the orbiting scroll member 10. As shown in FIG. 5(*a*), the gas pressure Fg acts perpendicularly to the centrifugal force Fc.

As a result, a resultant force F from the centrifugal force Fc and the gas pressure Fg acts on the eccentric shaft 22 obliquely rightward toward the top as viewed in FIG. 5(*a*). The resultant force F gives a torque to the variable crank 19 such that the variable crank 19 rotates about the fitting shaft 21 relative to the driving shaft 7.

More specifically, at the initial stage of running, including a halt, as shown in FIG. 3, the surface coating layers 16 and 17, which are uneven, contact each other, thereby positioning the variable crank 19 with respect to the driving shaft 7 so that the axis of the eccentric shaft 22 lies at the position of the axis O2' shown in FIG. 5(*b*). By driving the driving shaft 7 in this state to rotate in the direction of the arrow R, the resultant force F acts on the variable crank 19, thus urging the fitting shaft 21 to rotate in the fitting hole 7C and also urging the eccentric shaft 22 to rotate clockwise about the fitting shaft 21.

Thus, at the initial stage of running, the dimension δ' between the axis O2 of the eccentric shaft 22 and the axis O of the driving shaft 7 (i.e. the orbiting radius of the orbiting scroll member 10) gradually increases to the dimension δ. Consequently, as the wrap 11B of the orbiting scroll member 10 performs an orbiting motion relative to the wrap 6C of the fixed scroll member 6, the surface coating layers 16 and 17 formed on the wraps 6C and 11B can be positively worn out by rubbing against each other such that the gap between the wraps 11B and 6C gradually reduces.

As a result, the irregularities on the uneven surface coating layers 16 and 17 are gradually ground (worn) as the orbiting radius of the orbiting scroll member 10 increases, thereby enabling the surfaces of the surface coating layers 16 and 17 to be formed into smooth curved surfaces without irregularities, as shown in FIG. 4, and permitting the gap between the surface coating layers 16 and 17 to reduce unlimitedly. In addition, the degree of gas-tightness in the compression chambers 12 can be surely increased.

Moreover, the stopper mechanism 23 sets the rotation angle of the variable crank 19 relative to the driving shaft 7 at an angle α shown in FIG. 5(*b*). Therefore, the orbiting radius variation of the orbiting scroll member 10 can be set at a value ε smaller than the thickness t of the surface coating layers 16 and 17 (ε<t). Thus, it is possible to surely prevent the surface coating layers 16 and 17 from being excessively worn to such an extent that the side surfaces of the wraps 6C and 11B are exposed.

Because the axis O2 of the eccentric shaft 22 and the axis O3 of the pin 24 are set at respective positions which are apart from the axis O1 of the fitting shaft 21 by distances L1 and L2, respectively, the ratio of the amount of movement of the axis O2 to the amount of movement of the pin hole 25 receiving the pin 24 when the variable crank 19 is rotated relative to the driving shaft 7 is equal to the ratio of the distance L1 to the distance L2.

That is, the relationship between the distance L1, the distance L2, the orbiting radius variation (value ε) of the orbiting scroll member 10, and the clearance C between the pin 24 and the pin hole 25 is given by $$C/\epsilon = L2/L1$$

The value ε is set at a value smaller than the thickness t of the surface coating layers 16 and 17, which is set at a small value, i.e. about 10 μm, and the distance L2 is set at a value sufficiently longer than the distance L1. Therefore, the clearance C can be set at a value sufficiently larger than the value ε, and it is possible to increase the allowable range of machining errors in formation of the pin 24 and the pin hole 25, which constitute the stopper mechanism 23.

Accordingly, machining of the pin 24 and the pin hole 25 is facilitated, and the orbiting radius variation of the orbiting scroll member 10 can be accurately regulated within the dimension ε by the orbiting radius varying mechanism 18 and the stopper mechanism 23.

Thus, according to this embodiment, a non-rigid surface coating layer 16 having a thickness t is formed on each side of the wrap 6C of the fixed scroll member 6, while a non-rigid surface coating layer 17 having a thickness t is formed on each side of the wrap 11B of the orbiting scroll member 10, and the orbiting radius varying mechanism 18 is provided between the driving shaft 7 and the orbiting scroll member 10, thereby gradually increasing the orbiting radius of the orbiting scroll member 10 from the value δ' to the value δ as the running stage of the machine changes from an initial stage to a normal running stage, and thus positively allowing the surface coating layers 16 and 17 to wear out by rubbing against each other.

As a result, the surface coating layers 16 and 17, which are uneven at the initial stage of running, can be formed into smooth curved surfaces without irregularities at the time of normal running. Accordingly, during the normal running, the space between the surface coating layers 16 and 17 can be hermetically sealed without a gap. Moreover, the degree of gas-tightness in each compression chamber 12 can be surely increased, and the compression performance of the scroll compressor can be improved to a considerable extent.

Further, the stopper mechanism 23 is provided between the driving shaft 7 and the orbiting scroll member 10, thereby regulating the rotation angle of the variable crank 19 relative to the driving shaft 7 to a predetermined rotation angle α, and thus setting the orbiting radius variation of the orbiting scroll member 10 at a small value ε. Therefore, even when the orbiting radius of the orbiting scroll member 10 increases from the value δ' to the value δ and the wear of the surface coating layers 16 and 17 correspondingly progresses, it is possible to prevent the surface coating layers 16 and 17 from being excessively worn to such an extent that the side surfaces of the wraps 6C and 11B are exposed. Moreover, it is possible to surely prevent the wraps 6C and 11B from directly contacting (sliding on) each other, which would otherwise cause the wraps 6C and 11B to wear undesirably. Thus, the lifetime, durability and so forth of the scroll fluid machine can be guaranteed for a long period of time.

Furthermore, the distance L2 between the axis O1 of the fitting shaft 21 and the axis O3 of the pin 24 is set at a distance sufficiently longer than the center-to-center distance L1 between the axis O1 of the fitting shaft 21 and the axis O2 of the eccentric shaft 22. Therefore, machining of the pin 24 and the pin hole 25 is facilitated, and the working efficiency in machining can be improved to a considerable extent.

Figure 6:
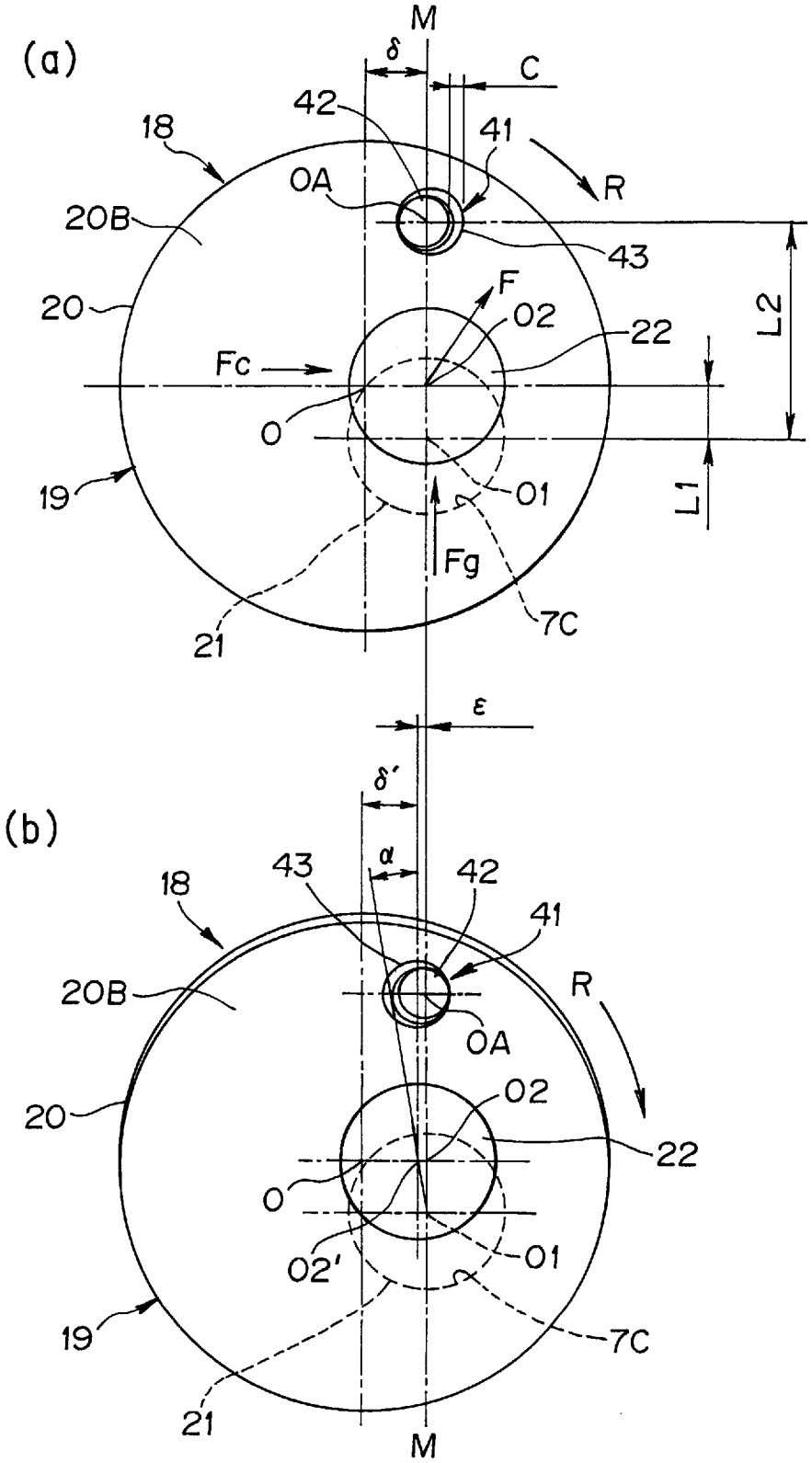
FIGS. 6(*a*) and 6(*b*) are enlarged views, similar to FIGS. 5(*a*) and 5(*b*) are for describing an operation of an orbiting radius varying mechanism according to a second embodiment of the present invention.
Figure 6A:
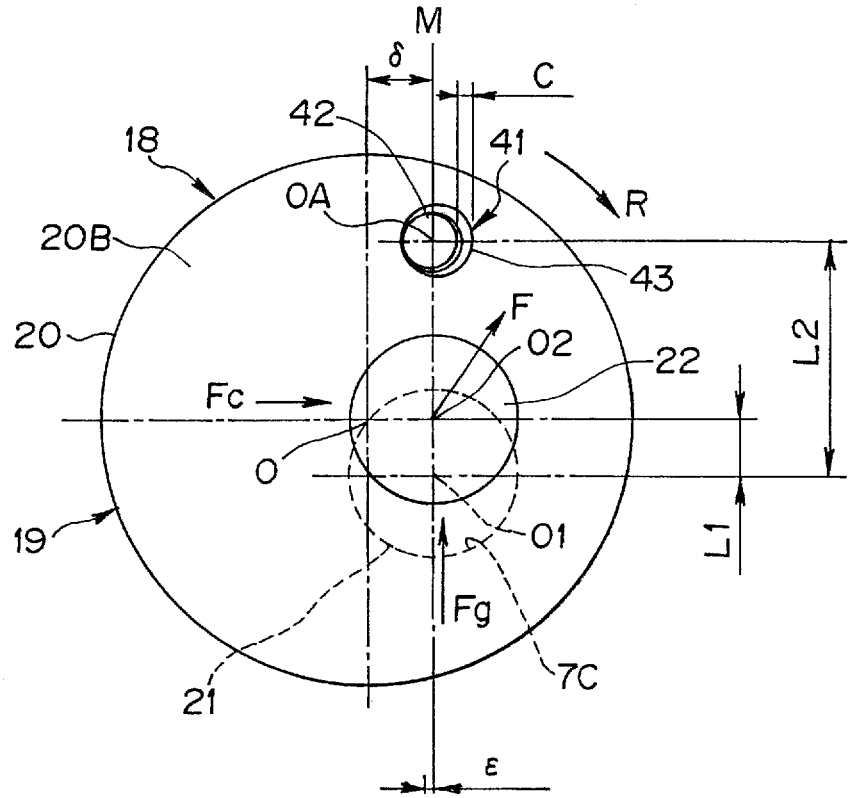
Figure 6B:
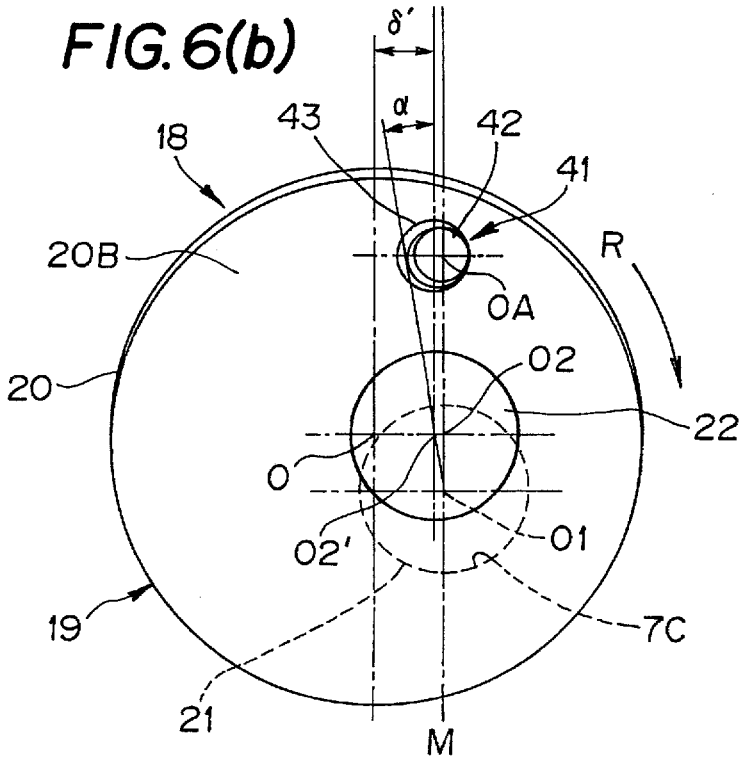

Next, FIGS. 6(*a*) and 7(*b*) show a second embodiment of the present invention. In this embodiment, the same members or portions as those in the first embodiment are denoted by the same reference characters, and a description thereof is omitted. The feature of this embodiment resides in that a stopper mechanism 41 comprises a pin 42 and a pin hole 43, and that the pin 42 is provided on the distal end surface of the disk portion 7B of the driving shaft 7 and comprises a support shaft portion 42A and a stopper shaft portion 42B, and further that the axis OA of the stopper shaft portion 42B lies substantially on a straight line intersecting both the axis O1 of the fitting shaft 21 and the axis O2 of the eccentric shaft 22.

Figure 7:
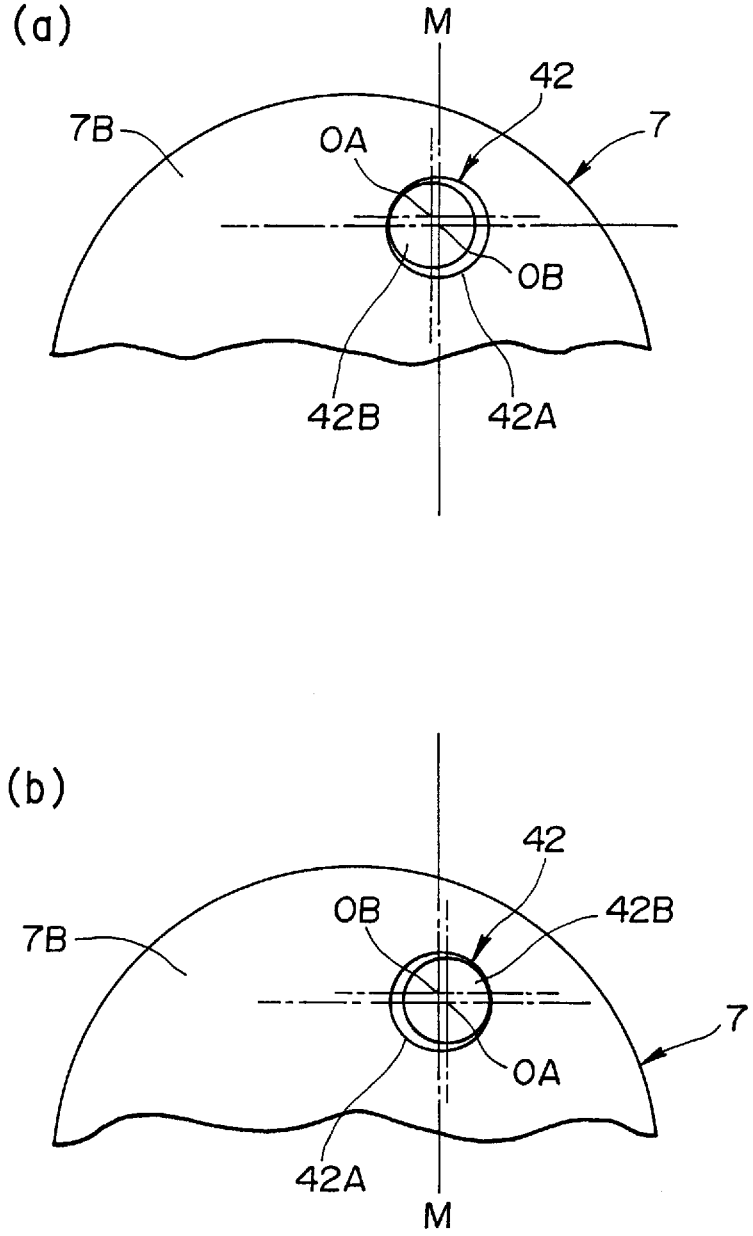
FIGS. 7(*a*) and 7(*b*) are enlarged views for describing an operation of a stopper mechanism shown in FIGS. 6(*a*) and 6(*b*).
Figure 7A:
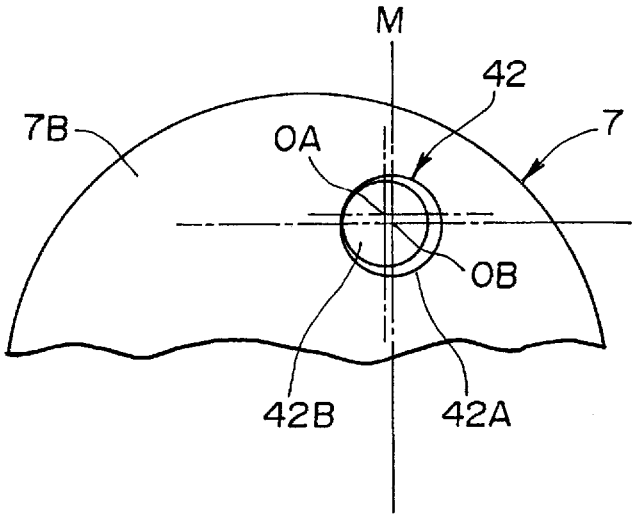
Figure 7B:
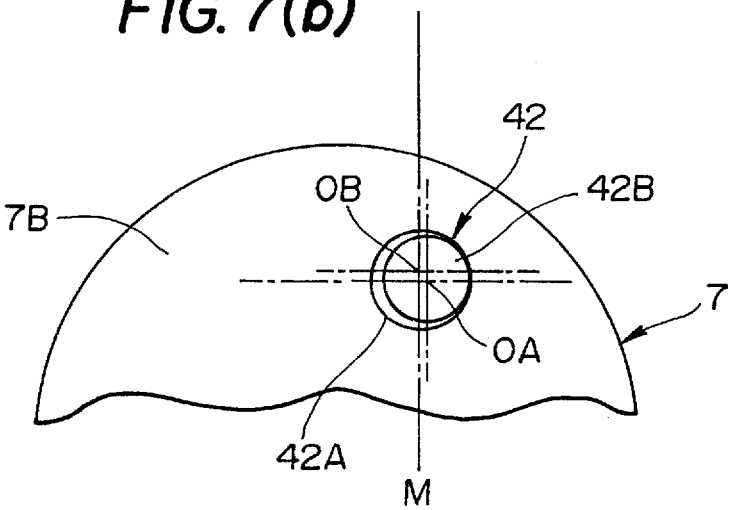

As shown in FIGS. 7(i a) and 7(*b*), the pin 42 comprises a columnar support shaft portion 42A having an axis OB, and a stopper shaft portion 42B integrally formed on one end surface of the support shaft portion 42A. The axis OA of the stopper shaft portion 42B is slightly eccentric with respect to the axis OB of the support shaft portion 42A by a predetermined dimension.

The disk portion 7B of the driving shaft 7 is provided with a fitting hole (not shown) for the support shaft portion 42A at a position in the outer peripheral portion of the distal end surface thereof. The fitting hole is fitted with the support shaft portion 42A. The arrangement is such that the position of the axis OA of the stopper shaft portion 42B can be selected as shown in FIGS. 7(*a*) and 7(*b*) by changing the rotation position of the support shaft portion 42A when press-fitted into the fitting hole.

As shown in FIGS. 6(*a*) and 6(*b*), the pin 42 is disposed such that the axis OA of the pin 42 lies substantially on a reference line M—M intersecting both the axis O1 of the fitting shaft 21 and the axis O2 of the eccentric shaft 22. The center-to-center distance between the axis OA of the pin 42 and the axis O1 of the fitting shaft 21 is set at a distance L2 sufficiently longer than the center-to-center distance L1 between the axis O1 of the fitting shaft 21 and the axis O2 of the eccentric shaft 22 (L2>L1) as in the case of the first embodiment.

The stopper shaft portion 42B of the pin 42 is inserted into a pin hole 43 formed in the variable crank 19. As is the case with the first embodiment, a gap having a clearance C is formed between the inner peripheral surface of the pin hole 43 and the stopper shaft portion 42B.

Thus, in this embodiment also, the rotation angle of the variable crank 19 relative to the driving shaft 7 can be accurately regulated to a predetermined rotation angle $\alpha$ by the stopper mechanism 41. Accordingly, the orbiting radius variation of the orbiting scroll member 10 can be set at a small value $\epsilon$. Moreover, the clearance C between the stopper shaft portion 42B of the pin 24 and the pin hole 43 can be made sufficiently larger than the value $\epsilon$. Thus, it is possible to obtain advantageous effects approximately similar to those in the first embodiment.

Further, in this embodiment, the pin 42 comprises a support shaft portion 42A and a stopper shaft portion 42B, and the axis OA of the stopper shaft portion 42B is eccentric with respect to the axis OB of the support shaft portion 42A. Therefore, by adjusting the rotation position of the support shaft portion 42A of the pin 42, the position of the axis OA of the stopper shaft portion 42B can be readily changed according to the adjusted rotation position of the support shaft portion 42A. The amount of rotation of the pin 42 is obtained by calculation from an error of the actually measured dimension of each finished component from the design dimension. The rotation position of the support shaft portion 42A is determined on the basis of the result of the calculation. Thereafter, the support shaft portion 42A is press-fitted into the fitting hole to secure the pin 42.

In this embodiment, therefore, when it is desired to adjust the size of the orbiting radius variation (value $\epsilon$) of the orbiting scroll member 10 according to the thickness t of the surface coating layers 16 and 17 at the initial stage of running, the pin 42 itself is rotated about the support shaft portion 42A, with the variable crank 19 mounted on the disk portion 7B of the driving shaft 7. By doing so, the size of the clearance C can be finely adjusted with ease, and it is also possible to readily change the size of the rotation angle $\alpha$ of the variable crank 19 relative to the driving shaft 7.

It should be noted that in the foregoing embodiments the fitting shaft 21 as a first shaft is provided on the variable crank 19, and the fitting hole 7C is provided in the distal end surface of the disk portion 7B of the driving shaft 7, thereby rotatably providing the variable crank 19 on the distal end surface of the disk portion 7B. However, the arrangement may be such that a columnar shaft similar to the fitting shaft 21 is provided on the distal end surface of the disk portion 7B, and one end surface of the disk 20 having an increased thickness is provided with a fitting hole in which the shaft is rotatably inserted.

In the foregoing embodiments, the eccentric shaft 22 as a second shaft is rotatably provided in the boss portion 15A of the back plate 15 through the orbiting bearing 32. However, the arrangement may be such that a boss portion is provided on the other end surface 20B of the disk 20, and the back plate 15 is provided with a columnar shaft similar to the eccentric shaft 22, thereby rotatably providing the shaft in the boss portion through an orbiting bearing.

Although in the foregoing embodiments the present invention has been described by taking a scroll air compressor as an example of a scroll fluid machine, it should be noted that the present invention is not necessarily limited to it but may be widely applied to other types of scroll fluid machine, e.g. vacuum pumps, refrigerant compressors, etc.

As has been detailed above, according to the present invention, a wrap of at least either one of orbiting and fixed scroll members is provided with a surface coating layer of a material less rigid than the wrap, and an orbiting radius varying mechanism is provided between the distal end of the driving shaft and the orbiting scroll member to vary the orbiting radius of the orbiting scroll member. Thus, at the initial stage of a compression operation, the orbiting radius of the orbiting scroll member is gradually increased, thereby allowing the surface coating layers formed on the wraps to rub against each other. Thus, the surface coating layers can be positively worn, and the surfaces of the surface coating layers can be formed into smooth curved surfaces without irregularities.

Accordingly, the gap between the surfaces of the surface coating layers can be reduced unlimitedly, and each compression chamber formed between the wraps of the orbiting and fixed scroll members can be reliably hermetically sealed. Moreover, the degree of gas-tightness in each compression chamber can be surely increased, and the compression performance of the scroll fluid machine can be improved to a considerable extent.

Further, because the orbiting radius varying mechanism is provided with a stopper mechanism for regulating the orbiting radius variation of the orbiting scroll member to a value smaller than the thickness of each surface coating layer, even when the orbiting radius of the orbiting scroll member increases and the wear of the surface coating layers correspondingly progresses, it is possible to reliably prevent the surface coating layers from being excessively worn to such an extent that the side surfaces of the wraps are exposed. Moreover, it is possible to surely prevent the wraps from directly contacting (sliding on) each other, which would otherwise cause the wraps to wear undesirably. Thus, the lifetime, durability and so forth of the scroll fluid machine can be guaranteed for a long period of time.

In the example in which the orbiting radius varying mechanism comprises a variable crank having a first shaft and a second shaft, the second shaft is subjected to centrifugal force and the gas (fluid) pressure in the compression chambers during a compression operation. Therefore, the center-to-center distance between the axis of the second shaft and the axis of the driving shaft, that is, the orbiting radius of the orbiting scroll member, can be readily varied by utilizing a resultant force from the centrifugal force and the gas pressure.

Furthermore, the orbiting radius variation of the orbiting scroll member can be reliably regulated by restricting the relative rotation between the variable crank and the driving shaft to a predetermined rotation angle through the stopper mechanism.

According to the second embodiment of the present invention, when it is desired to adjust the size of the orbiting radius variation of the orbiting scroll member according to the thickness of the surface coating layers at the initial stage of a compression operation, the pin itself is rotated about the support shaft portion, with the variable crank mounted on the driving shaft, thereby enabling the clearance between the stopper shaft portion and the pin to be finely adjusted with ease. Accordingly, it is possible to eliminate the need of a troublesome operation in which the size of the clearance is varied by moving the whole variable crank relative to the driving shaft. Thus, the working efficiency in such an positioning operation can be surely improved.

What is claimed is:

1. In a scroll fluid machine comprising a casing; a fixed scroll member integral with said casing, said fixed scroll member having a spiral wrap standing on an end plate; a driving shaft rotatably supported at a proximal end thereof by said casing, said driving shaft having a distal end portion extending into said casing; and an orbiting scroll member orbitably provided on the distal end portion of said driving shaft, said orbiting scroll member having a spiral wrap standing on an end plate so as to overlap said wrap of said fixed scroll member to define a plurality of compression chambers therebetween;

the improvement which comprises:

a surface coating layer formed on at least either one of the wraps of said orbiting scroll member and fixed scroll member, said surface coating layer being made of a material less rigid than said wraps;

an orbiting radius varying mechanism provided between the distal end of said driving shaft and said orbiting scroll member to vary an orbiting radius of said orbiting scroll member;

a stopper mechanism provided on said orbiting radius varying mechanism to limit a variation in the orbiting radius of said orbiting scroll member to a value smaller than the thickness of said surface coating layer; and said orbiting radius varying mechanism having a variable crank comprising a first shaft rotatable mounted on the distal end of said driving shaft with an eccentricity with respect to an axis of said driving shaft, and a second shaft for rotatable supporting said orbiting scroll member, said second shaft being eccentric with respect to both an axis of said first shaft and the axis of said driving shaft, said stopper mechanism being arranged to limit relative rotation between said variable crank and said driving shaft to a predetermined rotation angle.

2. A scroll fluid machine according to claim 1, wherein said stopper mechanism comprises a pin provided on the distal end of said driving shaft apart from the axis of said driving shaft by a predetermined distance, and a pin hole formed in said variable crank so as to receive said pin with a clearance.

3. A scroll fluid machine according to claim 2, wherein said pin comprises a support shaft portion provided on the distal end of said driving shaft, and a stopper shaft portion eccentric with respect to said support shaft portion, said stopper shaft portion being inserted into said pin hole of said variable crank.

* * * * *